United States Patent [19]

Calderon

[11] Patent Number: 4,469,488

[45] **Date of Patent: * Sep. 4, 1984**

[54] METHOD FOR GASIFYING COAL

[76] Inventor: Albert Calderon, 1065 Melrose, Bowling Green, Ohio 43402

[ * ] Notice: The portion of the term of this patent subsequent to Jun. 21, 2000 has been disclaimed.

[21] Appl. No.: 365,899

[22] Filed: Apr. 6, 1982

Related U.S. Application Data

[63] Continuation of Ser. No. 153,159, May 27, 1980, abandoned.

[51] Int. Cl.[3] ..... C10J 3/10; C10J 3/14; C10J 3/18

[52] U.S. Cl. ..... 48/202; 48/210; 60/39.02; 201/19; 201/38

[58] Field of Search ..... 48/65, 210, 202, 206, 48/101, 62 R, 197 R; 201/38, 39, 19; 60/39.12, 39.02; 110/229

[56] References Cited

U.S. PATENT DOCUMENTS

| | | | |
|---|---|---|---|
| 1,097,513 | 5/1914 | Benner | 48/202 |
| 1,524,784 | 2/1925 | Bartolomeis et al. | 201/19 |
| 1,713,189 | 5/1929 | Marshall | 48/202 |
| 2,509,921 | 11/1945 | Gwynn | 13/27 |
| 2,683,657 | 7/1954 | Garbo | 48/202 |
| 4,389,283 | 6/1983 | Calderon | 201/19 |

*Primary Examiner*—Peter F. Kratz

*Attorney, Agent, or Firm*—Maky, Renner, Otto & Boisselle

[57] ABSTRACT

An improved method for generating gas from coal including caking and high sulfur coals, in a completely enclosed system wherein no oxygen or air is used to burn a portion of the coal and/or char to produce heat for the reaction. The heat for the reaction of the instant invention is produced by electric induction coils surrounding a vertical retort which possesses a plurality of compartments or cells whose walls are heated by induction. Energy requirement is reduced by pressurizing and methanating within the compartments in order to benefit from exothermic reaction of the methane formation. The coal charged is heated by said walls so that the coal is converted from coal to coke or char by driving the volatiles from the coal in a controlled and efficient manner. The char is further kept hot by the same heated walls of said compartments and also by direct induction to make possible the generation of gas, mainly CO and $H_2$ by reacting steam with said hot char. The coal is charged at the top of said retort, in a sealed manner and the ash removed from the bottom without causing pollution. The conditions within said compartments are such that the CO formed is made to react with the $H_2$ in the coal as the CO rises to form $CH_4$ and $H_2O$ and give off heat to result in reducing the heat energy induced by the induction coils. The hot generated methanated gas rises within said retort and leaves it at the top thence it is directed to a desulfurizer for cleaning. The gas is then used in different ways.

36 Claims, 13 Drawing Figures

METHOD FOR GASIFYING COAL

This is a continuation of application Ser. No. 153,159, filed May 27, 1980, now abandoned.

The present invention discloses an improved method and apparatus for generating gas from coal and relates to the co-pending applications of the applicant bearing Ser. Nos. 921,760 now abandoned and 131,137 filed on July 3, 1978 and Mar. 17, 1980 respectively. The first appliction pertains to the making of coke devoid of pollution in a retort making use of induction heating while the second appliction pertains to the direct reduction of iron ore in a retort also making use of induction heating. Both aforesaid applications efficiently heat the charge by the introduction of a plurality of compartments or cells within said retorts in order to transfer the heat to the total charge. The efficiency of heat transfer from the walls of said compartments as well as the uniformity of such heating has recently been demonstrated at Ohio State University, Department of Metallurgical Engineering.

In the gasification of coal, numerous processes have been and still are offered. Most of them use either air or oxygen to burn a portion of the coal and/or char to produce the heat for the reaction; the processes that use air and/or oxygen bear the following names: Lurgi, Winkler, Bi-Gas, Synthane, Atgas, Hydrane, Koppers Totzek, Molten Salt, and U-Gas. A process belonging to Consolidation Coal Company called "$CO_2$ Acceptor Process", does not use air or oxygen in the gasifier but provides the heat for reaction of carbon with steam by reacting the $CO_2$ which is formed when dolomite is calcined; however, char is burnt in the dolomite regenerator with air. The "HYGAS" process teaches the hydrogasification of coal. Coal in an oil slurry is injected into the top of a high pressure reactor which operates at 1000 psi and a hydrogen rich gas is injected at the bottom of the reactor. Also char is removed from the reactor and directed to a second unit which takes the form of a gasifier and which possesses a fluidized-bed in which a portion of the char is reacted with steam to make a hydrogen rich gas for injection into the reactor, and the balance is used for power generation. The heat in the fluidized-bed gasifier to generate the required hydrogen can be provided by one of three alternate ways:

1. By passing an electric current through the fluidized-bed.
2. By combustion of a portion of the char with oxygen in the fluidized-bed.
3. By combustion of char with air to make producer gas which is contacted with iron oxide.

The relationship of the instant invention to the "HYGAS" process is its reference to using electricity. The differences between the instant invention and the "HYGAS", is that the instant invention does not pass an electric current through a fluidized-bed nor the instant invention uses the char from the gasifier for power generation. Further the HYGAS process uses complicated and separate vessels; namely the employment of oil to make a slurry in order to be able to inject it into a high pressure reactor, high pressure injection of the $H_2$-rich gas, the movement of hot char from the reactor to the gasifier, the partial gasification of the char in the gasifier and the flow of electric current through a fluidized bed in a steam environment. The HYGAS process does not teach the use of induction heating, nor the use of induction heating in a special way to result in the most efficient manner to transfer heat. The key to the most efficient gasification of coal resides in converting as much of the char as possible to gas in the shortest period of time in a non-polluting manner to prevent the formation of "Acid Rain", in operating dependably, and in being able to use "Caking" coals since this country mines more than 500 million tons of "Caking" coals per year. Since the solution to the energy crisis for the United States and for other countries with coal reserves, is the conversion of coal to gas which gas in turn is used as is, improved to pipeline quality or converted to liquid products and liquid fuel, the method of gasification and the gasifier itself become the heart of the coal-cnversion process. The instant invention provides a method and apparatus for gasifying coal which is superior to the aforementioned references by virtue of being a fast-acting method, which involves the using of a completely closed retort wherein the heat transfer to the coal charged is uniform and efficient to first volatilize the coal to convert it to a char and next to efficiently react the char with steam to generate CO and hydrogen. Since the generation of CO and hydrogen is endothermic the efficient heat transfer of the instant invention reheats the char and brings it back to the reactive temperature very rapidly so that additional steam is injected to react with more char and generate additional gas. Coal is charged at the top of said retort and ashes are removed at the bottom and since the said retort operates under a positive pressure, the volatiles and gas generated are pushed out from the top. The gas is desulfurized and is used for any one of several purposes.

Unlike the references cited, the efficient heat transfer of the instant invention is accomplished by providing a compartmentalized retort to form a plurality of compartments whose walls are heated by induction and wherein said compartments are insulated and isolated from each other to insure that the walls of each of said compartments are uniformly heated and the heat cannot dissipate itself except transfer itself to the charge contained in each and every compartment. Upon carbonization of the coal, the char is also heated not only by said walls but also by direct induction. Since during gasification by the reaction of steam with hot char, heat is rapidly lost in the char, it is of utmost importance to re-heat the char as rapidly as possible and induction heating as disclosed in the instant invention makes this happen to result in a very efficient gasification process.

Therefore, the main object of the present invention is to provide a method and apparatus for coal gasification of such high efficiency which heretofore has not been possible.

Another object of the present invention is to provide a method and apparatus for coal gasification which is completely closed and does not burn either coal or char to generate the heat for the reaction and which will meet the Clean Air Act and prevent the formation of "Acid Rain".

Further, an object of the instant invention is to provide a method and apparatus for coal gasification capable of using all types of coal including "Caking" as well as high sulfur coals.

Yet an object of the instant invention is to provide a method and apparatus for coal gasification capable of volatilizing the coal and converting most of the char to gas in a single vessel by having the capacity to re-heat the char very rapidly to compensate for the heat loss taking place during gasification in order to consume most of the char to result in an efficiency of better than 95% char consumption.

Further yet, an object of this invention is to provide a method and apparatus for coal gasification capable of heating the entire charge efficiently by using the principle of induction heating with the charge being dispersed in separate compartments whose walls are heated by said induction heating to result in uniform, controllable, and efficient heat transfer for carbonization and for gasification.

Further, another object of this invention is to provide a method and apparatus for the gasification of coal using the principle of induction heating to provide heat for the reaction to efficiently generate CO and $H_2$ by using steam and induction heating, and to provide pressure and temperature conditions conducive to the formation of $CH_4$ by causing the additional reaction of CO with the $H_2$ contained in the coal volatiles to result in an exothermic reaction to help reduce the power requirement of said ininduction heating.

Yet another object of this invention is to provide a method and apparatus for the gasification of coal using the principle of induction heating to provide heat for the reaction capable of using the gas generated for the electric power generation for the furnishing of the power requirements of said induction heating and also for making available electric power to the open market.

Therefore another object of this invention is to provide a method and apparatus for the gasification of coal using the principle of induction heating to provide heat for the reaction capable of using a portion of the gas generated for electric power requirements of said induction heating and the balance available for using as a higher heating value gas.

Further yet, another object of the instant invention is to provide a method and apparatus for the gasification of coal using the principle of induction heating for providing heat for the reaction capable of making medium BTU gas for conversion to pipe line quality.

Further, therefore, another object of the instant invention is to provide a method and apparatus for the gasification of coal using the principle of induction for providing heat for the reaction capable of making medium BTU gas for conversion to clean liquid fuel.

Therefore, yet an object of the instant invention is to provide a method and apparatus for the gasification of coal using the principle of a single retort which is completely closed and which uses the principle of induction heating for the heat of reaction instead of burning coal and/or char which is capable of high productive rates and requiring a relatively small investment.

It is an object of the instant invention to provide a method and apparatus for the gasification of coal using the principle of induction heating to result in a compact, fast-acting system which requires a relatively small crew to operate.

It is another object of the instant invention to provide a method and apparatus for the gasification of coal using the principle of induction heating to result in a dependable system that is easily maintained.

Other objects of this invention will appear from the following detailed description and appended claims, reference being made to the accompanying drawings forming a part of this specification wherein like reference characters designate corresponding parts in the several views.

BRIEF DESCRIPTION OF DRAWINGS

FIG. 12 is a schematic drawing of the instant invention. It shows a vertical retort equipped with a material handling system, a feeding means to introduce the coal into the retort, a duct-work for the removal of the gases, a plurality of induction coils surrounding the retort above which a distribution system for the coal is situated. Beneath the induction coils, a steam injection system is provided to react with the char made in the retort. The ash of the coal is collected below the steam injection system and is conveyed by a screw conveyor for disposal. The duct work for the gases above the retort are directed to a desulfurizer which contains a desulfuring agent. The fresh desulfurizing agent is added at the top and the poisoned desulfurizing agent is removed at the bottom also for disposal.

FIG. 13 is a partial pictorial schematic drawing showing a portion of the lower part of the retort. The individual compartments containing the charge are shown partially and the manner in which the compartments are supported. The steam injection into the bottom of each compartment and the ash collection hopper are also shown in part.

FIG. 1 is a diagramatic representation of the invention showing the retort, the coal charging means at the top and the ash discharging means at the bottom. The induction heating coils surround the retort and the steam injection system is located below the coils. The duct work for the gases leaves the top of the retort and enters the bottom of the desulfurizer. The gases after desulfurization enter the combustion chamber of the gas turbine where they are burned and in this manner the turbine is driven. The exhaust from the gas turbine is directed to the waste heat boiler where steam is generated and this steam is directed through an accumulator to the second turbine which is driven. The two turbines form the combination for the combined cycle power generation.

FIG. 2 is a section taken at 2—2 of FIG. 1 showing the lower portion of one of the compartments which is heated by induction and which contains a portion of the charge.

FIG. 3 is a diagramatic representation of the invention showing the retort, the coal charging means at the top and the ash discharging means at the bottom. The induction heating coils surround the retort and the steam injection system is located below the coils. The arrangement is such that the gas generated and the gas volatilized are put under high pressure in the retort in order to convert to methane which is passed through a duct catcher, desulfurized, and quenched, thence it is further upgraded to pipe line quality, directed to a liquification process for making liquid hydrocarbons, or used as a higher heating value gas. This new gas can also be used in a boiler as a substitute for coal or oil, and in so doing, the gas is directed to the boiler whilst still hot and under pressure without the necessity of having it quenched, this being shown in dotted in FIG. 3.

FIG. 4 is a section through the gasifier. It shows the overhead duct-work, the crown, the compartments, the structural supports, the induction heating coils, the steam injection system, the charging means at the top and the ash discharging means at the bottom. It also shows within the crown the shearing-distribution blades to distribute the coal into the compartments and also to break up the coal which swells because of the caking properties of the coal.

FIG. 5 is a partial section of one of the compartments showing that the walls of the compartment are tapered to diverge downwardly, as an alternate construction.

FIG. 6 is a section showing the top of a plurality of compartments with the coal swollen and rising from the compartments.

FIG. 7 is a section taken at 7—7 of FIG. 4. It shows the plan view of a lower part of one of the compartments.

FIG. 8 is a section taken at 8—8 of FIG. 7. It shows an enlarged view of the lower part of one of the compartments with a vibratory grate to shake the ashes from the gasification portion of the compartment.

FIG. 9 is a top sectional view of the crown of the retort showing the plurality of the compartments taken at 9—9 of FIG. 1. The shearing-distribution blades are also shown and the opposite direction they rotate in order to break up and distribute the swollen mounds of coal caused by the caking properties of the coal.

FIG. 10 is a sectional view of the ash collection hopper. It shows the manner in which the bottom of each compartment connects to the collection hopper.

FIG. 11 is a partial sectional view of one of the compartments wherein the gas generated is withdrawn from an intermediate point of the retort rather than the top.

Before explaining in detail the present invention, it is to be understood that the invention is not limited to the details of construction and the arrangement of the parts illustrated on the accompanying drawings since the invention is capable of other embodiments. Also, it is to be understood that the phraseology or terminology herein is for the purpose of description and not limitation.

DETAILED DESCRIPTION OF DRAWINGS

Figure 12:
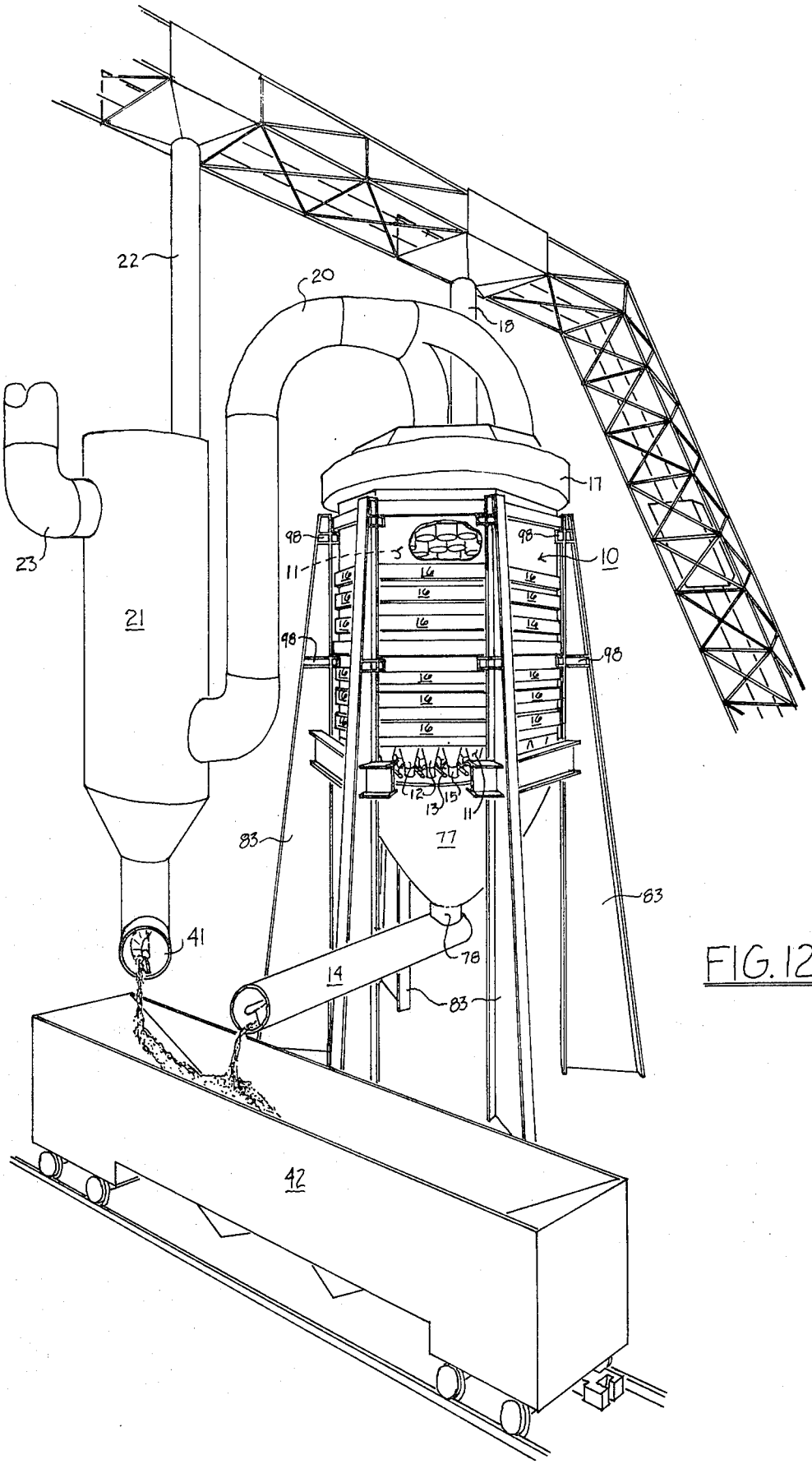

In FIG. 12 numeral 10 represents the retort in which 17 is the crown, 18 is the charging means for coal and 20 is the overhead duct work to take away the gases from the retort. The induction coils are denoted by numeral 16. Hopper 77 for disposal of the ash forms the lower part of retort 10 while screw conveyor 14 by means of interconnection 78 is disposed to hopper 77. Retort 10 is supported by pedestals 83. Desulfurizer 21 which preferably is adapted to contain a desulfurizing agent such as calcium oxide is communicated to retort 10 by means of duct work 20 in such a manner as to direct the gas to the bottom of desulfurizer 21 and discharge the gas after desulfurization through duct 23. The charging system 22 for the desulfurizing agent is mounted to the top of desulfurizer 21 and a discharge means 41 is disposed to the bottom of desulfurizer 21 for disposal of the poisoned desulfurizing agent. Both conveyor 14 and disposal means 41 which may also be a screw conveyor feed the waste material to railway car 42. Retort 10 is made up of a cluster of compartments or cells preferably in the form of circular tubes marked by numeral 11 which tubes extend from crown 17 at the top to ash disposal hopper 77.

Figure 13:
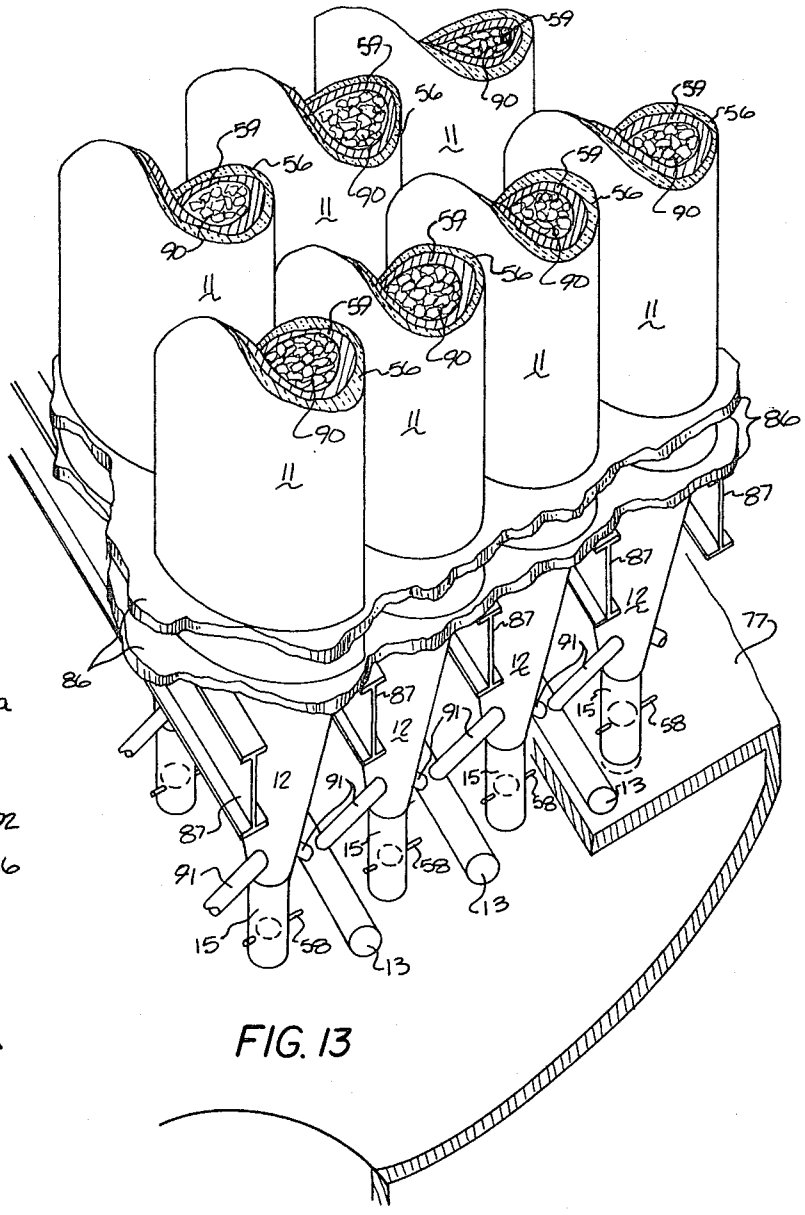
FIGS. 12 and 13 are pictorial.

In FIG. 13 the gasifying compartments are denoted by numeral 11. Each compartment is made preferably of iron or steel tube 59 to contain the coal or the char which is marked by numeral 90. Insulating material 56 insulates as well as isolates each compartment 11 from its neighboring compartment in order to avoid electrical as well as thermal transfer. Compartments 11 are supported on plate 86 which takes the form of a tube sheet which preferably is water-cooled and supported on beams 87. The lower portion of each compartment 11 preferably takes the form of cone 12 to which a tubular extension 15 is disposed. A valve 58 is mounted in extension 15 to control the discharge of ash from each compartment 11 to hopper 77. Steam injection headers 13 are disposed preferably below cones 12 to serve as common steam feeders in order to inject steam into each cone 12 by means of pipe branches 91.

Figures 1, 2:
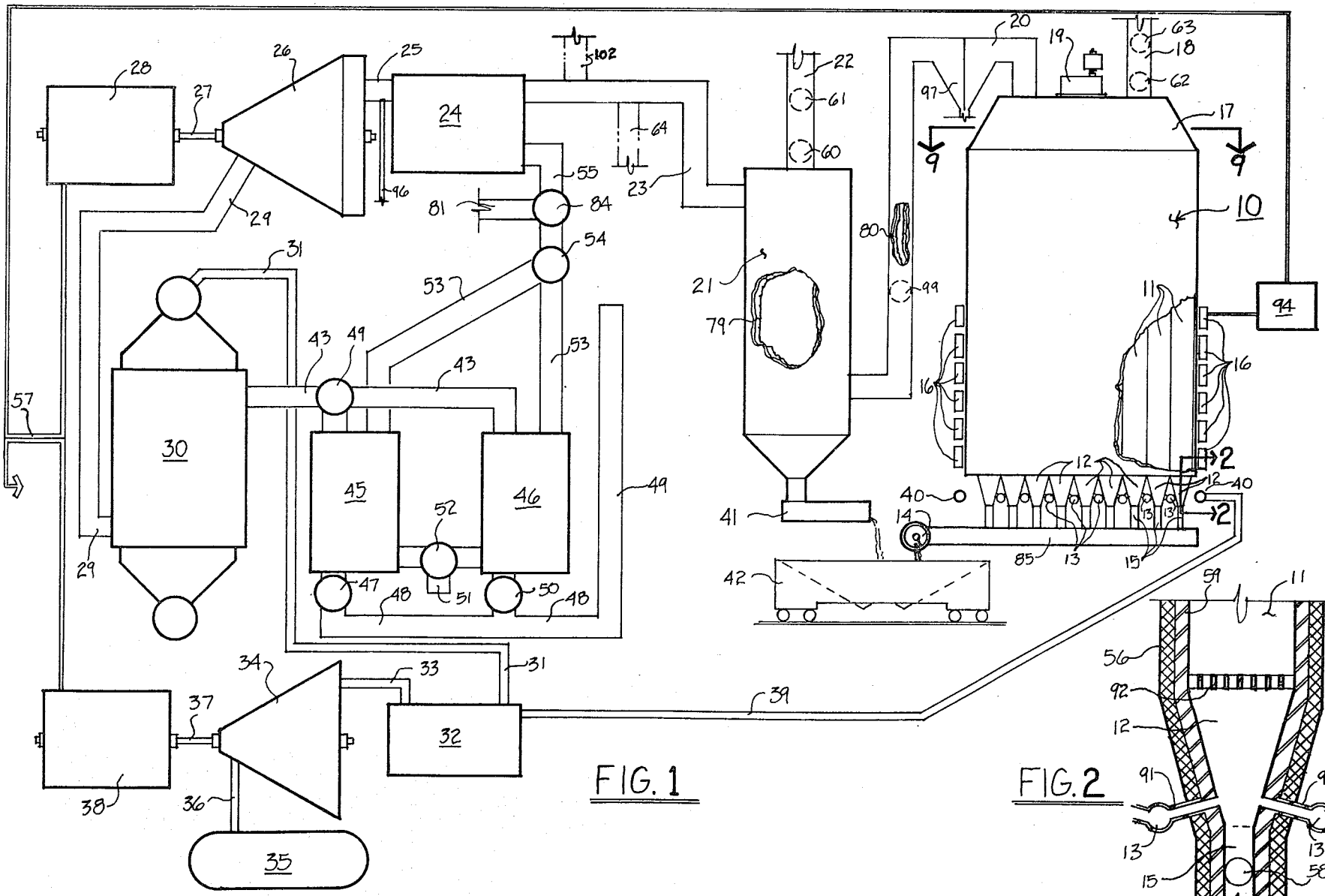
FIGS. 1 through 11 are diagramatic and sectional representations.

In FIG. 1 retort 10 possesses above crown 17, driving mechanism 19 for distributing the charge and also for shearing the coal that bloats because of its caking properties. Insulation 80 is disposed within duct work 20 in order to minimize temperature drop of the gas while the gas is directed to desulfurizer 21 which in turn is also insulated as shown by insulation 79. The charging system for the coal which is denoted by numeral 18 possesses a two-gate arrangement 62 and 63 in order to prevent gases from leaving retort 10 through charging means 18. Charging system 22 of desulfurizer 21 also possesses a two-gate arrangement 60 and 61 to prevent gases escaping from charging means 22. The gas made in retort 10 is preferably maintained at such a temperature to prevent the condensation of by-products. The gas is directed to combustion chamber 24 by means of duct 23 wherein the gas is burned by air introduced through intake 81 and controlled by valve 84 or by air which is introduced into intake 51 and controlled by valve 52 and thence pre-heated either in recuperator 45 or 46 and wherein valve 54 is used to selectively control the intake of pre-heated air from either recuperator 45 or 46. The combustion gases burned in combustion chamber 24 are directed into turbine 26 via duct 25. In turn turbine 26 is connected to generator 28 by means of shaft 27 to generate electrical power using the principle of a gas turbine. The exhaust from gas turbine 26 is directed by duct 29 to communicate with steam boiler 30 from which steam is directed to accumulator 32 by means of pipe 31. Steam from boiler 30 either directly or through accumulator 32 is fed into steam turbine 34 by means of pipe 33. Turbine 34 is connected to generator 38 by means of shaft 37 to generate electric power using the principle of a steam turbine. The condensate from turbine 34 is accumulated in condenser 35. Power from both generator 28 and 38 result from a combined cycle and a portion of the electrical power is fed to power source 94 of induction coils 16. The balance of the power generated is available for other applications including its sale in the open market. The exhaust from waste heat boiler 30 is directed by means of duct 43 through valve 49 to pre-heat recuperators 45 and 46 in such a way as to use either control 47 or control 50 and direct the exhaust from recuperator 45 or 46 respectively. The exhaust out of either recuperator is directed to duct 48 and out through stack 49. Steam for gasification is taken from accumulator 32 and directed by means of duct 39 to main header 40 which distributes the steam to secondary headers 13. If desired the gas after desulfurization in desulfurizer 21 may be quenched before entry into combustion chamber 24 by any one of known ways.

In certain applications, it is preferred to keep the temperature of the gases hot enough so that all the organic material in the gas are burnt and incinerated in combustion chamber 24 to avoid the installation of complicated gas cleaning equipment. In such applications, the preheating of the combustion air in recuperators 45 or 46 becomes more important to guarantee such incineration, and in so doing, excess air may be introduced into turbine 26 by means of pipe 96 if overheating of the blades of turbine 26 takes place. Water-cooled blades in turbine 26 may obviate the necessity of introducing such excess air. Gasifier 10 may be operated with purchased electric power and the gas after being cleaned of its tars and oils, is piped for other uses by means of pipe 64 shown in phantom.

Conveyor 41 at the bottom of desulfurizer 21 is used for the disposition of the poisoned desulfurizing agent into railway car 42 and the ash from retort 10 is disposed by conveyor 14 and preferably into the same car. Dust collection hopper 97 may be installed to collect particulates prior to desulfurization which particulates may be recirculated; however, tests in laboratory scale to date have shown that the gas leaving the top of retort 10 carry practically no particulate matter.

In FIG. 2, 11 is the compartment used for volatilization and gasification whose walls are made of a material suitable for induction heating such as iron or steel which is marked by numeral 59. The outside of compartment 11 is completely insulated by a material such as fiberfrax which is known in steel-mill application and which is denoted by numeral 56. Grate 92 is situated towards the bottom of compartment 11 to sift the ash for disposal. Control valve 58 feeds the ash out of compartment 11. Steam injection headers 13 are suitably mounted in cone 12 by means of branches 91 in order to direct steam to bottom of compartments 11.

To operate retort 10 under high pressure and provide means for maximum thermal efficiency for gasification and methanation, valve 99 is provided in order to control the pressure within retort 10 and take advantage of the reaction of the hydrogen generated during the reaction of steam with the char but especially with the coal. Compartment 11 is made of such suitable height as to enhance the hydrogen reaction with additional char but mainly with the coal located above the char in compartment 11 to form methane directly within each compartment 11 in order to increase the BTU value of the gas; this approach with adequate pressure such as 400 psi delivers a high degree of gasification as well as high degree of methanation in a single unit. By making a gas of high temperature, high pressure and high BTU content the process provides such a burning condition when coming in contact with preheated air in combustion chamber 24 to consequently give a great improvement in thermal conversion cycle efficiency while at the same time incinerate the tars and the phenols within combustion chamber 24 without the necessity of special gas cleaning equipment for the exhaust gas. Such high thermal conversion cycle efficiency is applicable to the following: (a) coal fired boilers, (b) boilers using oil and natural gas, (c) combined cycle power generation using excess air in the gas turbine to prevent overheating of the blades, and (d) combined cycle with water cooled blades for power generation.

Figure 3:
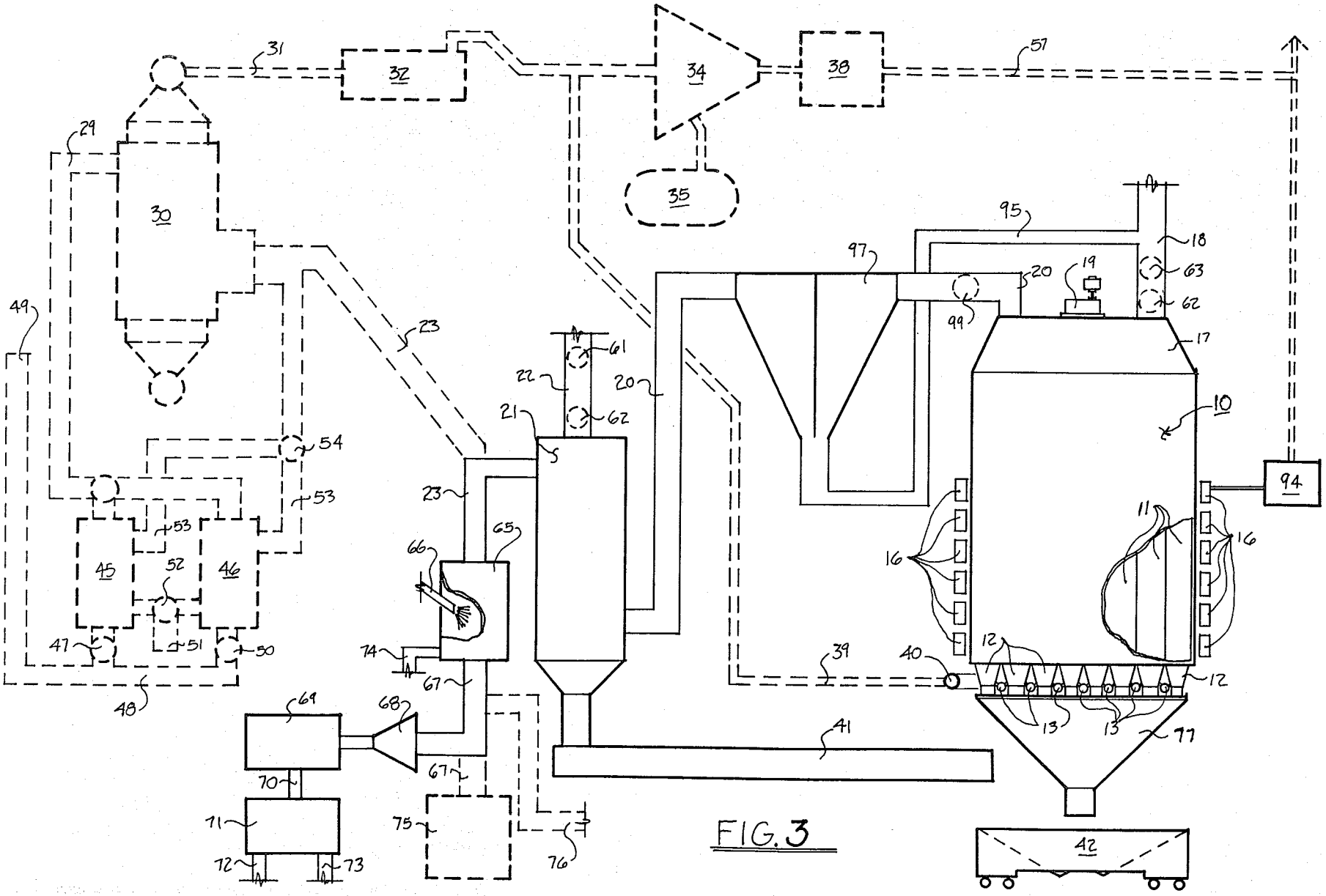

The present method and apparatus shown by FIG. 3 is to be used for industrial purposes such as the making of a gas rich enough for introduction into a natural gas pipe line system or for making gas suitable for conversion to liquid hydrocarbons or for making gas for delivery to industrial plants for heating and processing. Numeral 10 represents the retort. It is made up of a plurality of compartments 11 assembled in a cluster, which cluster is surrounded by induction coil means 16. Each compartment possesses a discharge means 12 for the disposal of ash into hopper 77 which in turn disposes of the ash preferably into car 42. The top of retort 10 is made in the form of crown 17 which is adapted to receive coal through charging means 18 and also dispose of the gas by means of duct work 20. Preferably coal distributing means 19 is mounted above crown 17. A steam injection means 40 is disposed below induction coil means 16 for the distribution of steam by means of pipes 13 in order to inject steam into each compartment 11. Pressure valve 99 controls the pressure within retort 10 in order to operate the retort at a high pressure such as 400 psi. The gas leaving the retort possesses a temperature of about 1,000° F. The gas first passes through dust catcher 97, thence to desulfurizer 21. Dust catcher 97 may be located downstream of desulfurizer 21. The gas after being purified in desulfurizer 21 is quenched in quencher 65 by means of coolant injector 66. The tars and oils in the gas are removed by pipe 74 from quencher 65 and the gas is directed to compressor 68 for further methanation in methanator 69. After methanation the gas is directed to dehydrator 71 and the water is separated from the gas. The clean, dry gas of pipe line quality is directed by pipe 72 for injection into a pipe line system. The water resulting from dehydration is directed by pipe 73 for recirculation or disposal.

The gas, after being quenched, may be directed to a liquification system 75 such as the Fischer-Tropsch process for the production of liquid hydrocarbons. The gas after quenching may also be directed to other uses such as heating amd processing and directed by pipe 76 to a distribution system (not shown). In certin applications where the gas is to be used as a substitute for coal, oil or gas fired boilers, the gas leaving desulfurizer 21 is maintained at a high temperature and is not quenched in quencher 65. The gas in turn is directed to the combustion chamber of the boiler used in connection with burning coal, oil, or gas, such as boiler 30 which is shown in dotted in FIG. 3. The gas is preferably burned with pre-heated air from recuperator 45 or 46 as previously explained. The steam made by boiler 30 is used for power generation as well as for furnishing the steam needed for gasification in retort 10. Power for induction coil 16 is furnished by generator 38.

DETAILED DESCRIPTION OF RETORT 10

Figure 4:
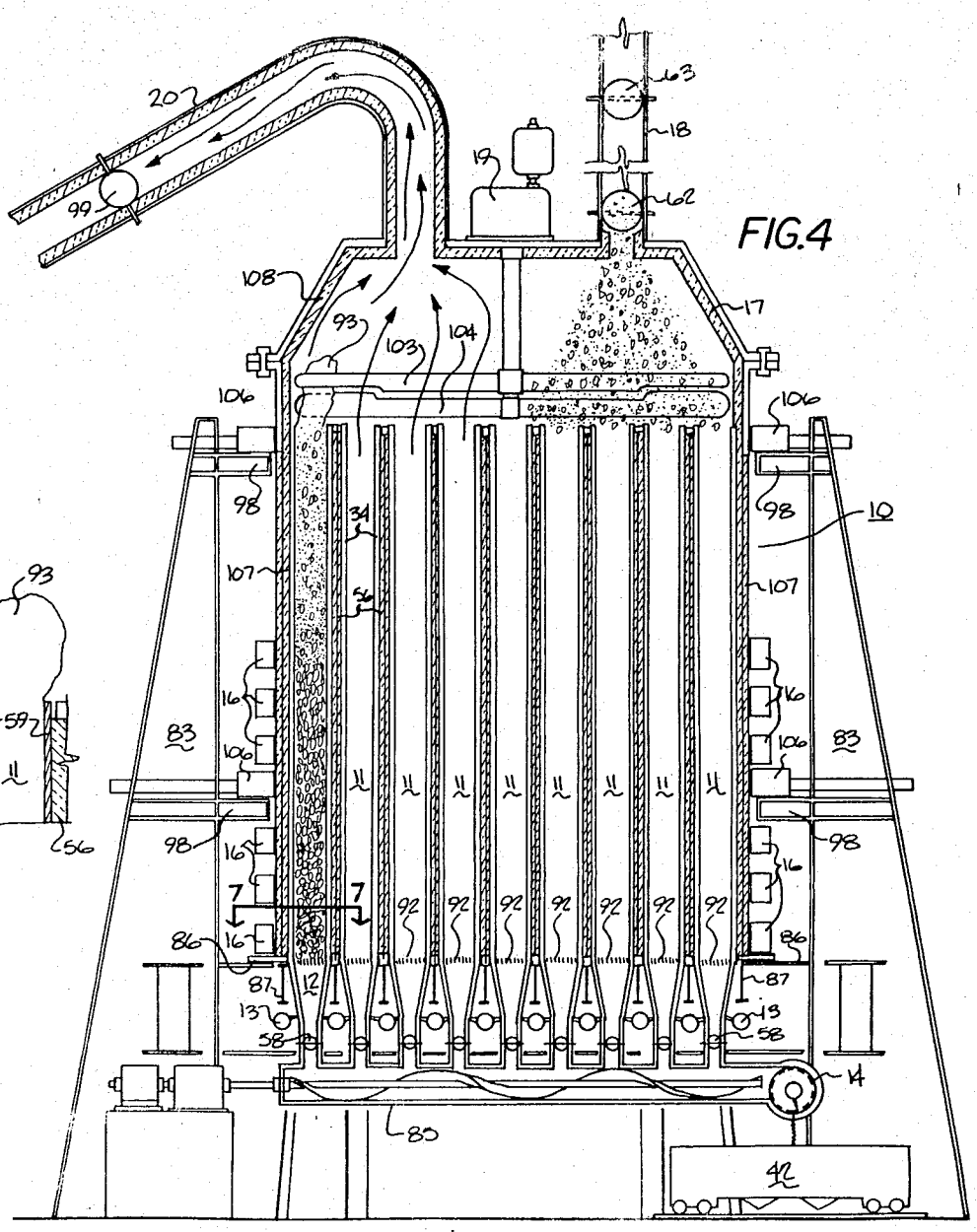

Retort 10 is made up of the following components: (i) a cluster of compartments 11 forming a vertical shaft; (ii) a distribution hopper in the form of a crown marked by numeral 17; (iii) a coal charging system 18; (iv) a gas removal system 20 in the form of a duct work; (v) induction heating system 16 surrounding the cluster of compartments 11; (vi) structural support 83 for retort 10; (vii) a steam injection system 13 at the bottom of compartments 11; and (viii) ash disposal system 14. FIG. 4, which is a vertical section through retort 10, shows the components enumerated above.

(i) Cluster Compartments 11

Figure 5:
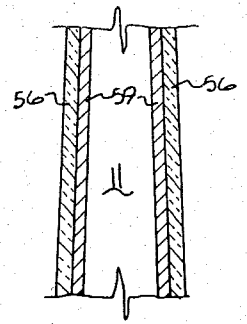

The vertical shaft of retort 10 is made up of a cluster of compartments shown by numeral 11 which extend vertically and form the heating zone for volatilization and gasification. Compartments 11 are insulated both electrically and thermally from each other by means of insulation 56. Compartments 11 are held in place at the bottom by plate 86 which preferably is water-cooled; it takes the form of a tube sheet which is supported on horizontal substructure 87. The shaft is divided into an upper portion for preheating and volatilization of the coal and the lower portion for heating the resultant char for gasification. The height of compartments 11 is such that the material is charred as it descends within each compartment, and upon the consumption of the char by the reaction of steam with the hot char, the charge continues to move downwardly while the gas made up of CO and $H_2$ rises within each compartment to further react with the char and with the coal for enrichment with hydrogen to form methane as the gas rises within each compartment towards crown 17. The walls of each compartment are made up of such material as to be heated efficiently by induction, such as iron or steel which may be cast of an analysis to withstand high temperature, erosion, and attack from corrosive chemicals. The shape of each compartment may take any geometric shape but preferably round. The compartments may taper divergently downwardly to avoid any sticking as shown by FIG. 5. Each compartment 11 is equipped with steam injection means 13 above which means, grate 92 is disposed to support the column of the char and coal. A thick layer of insulation marked by numeral 107 surrounds the entire cluster to maintain the heat of the cluster towards compartments 11.

(ii) Distribution Hopper

Figure 6:
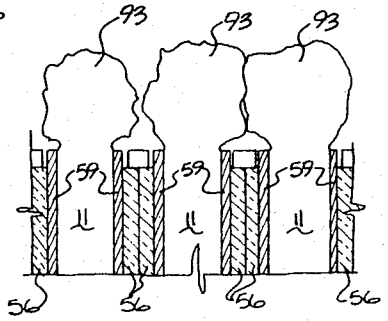

Above the compartments 11, the distribution hopper for the coal is situated. It takes the form of crown 17 which is equipped with a generous space in order to slow down the gas generated, provide room for the bloating of the caking coals and adequate room to distribute the coal so that coal is delivered to every compartment 11. Crown 17 is well insulated by means of insulation 108 to maintain the environment above compartments 11 at about 1,000° F. in order to prevent the condensation of tars. Drive means 19 is disposed over crown 11 to actuate distribution blades 103 and 104. Blades 103 and 104 rotate in opposite directions in order to insure that material is fed into each and every compartment 1 and also to shear the mass of caking coal that bloats when heated as shown by FIG. 6. The temperature within crown 17 is such that the bloating properties of the caking coals are destroyed to make possible the handling of such coals.

(iii) Coal Charging System 18

Retort 10 receives coal either continuously or semi-continuously, it is supplied by charging system 18 which system is designed to feed coal in a sealed arrangement such as double gate 62 and 63 to prevent the escape of gas since the pressure within retort 10 is high. Charging system 18 may take the form of any one of know arrangements.

(iv) Gas Removal System 20

As the coal is heated, gases are driven off. These gases which are rich in hydrogen, react with the CO generated from the reaction of steam injection onto hot char to form water gas ($CO+H_2$). The high pressure in retort 10 to cause formation of methane is maintained by valve 99. Duct 20 is properly insulated to prevent heat loss and the condensation of tar.

(v) Induction Coils 16

The heating zone of the shaft of retort 10 comprises about $\frac{2}{3}$ to $\frac{3}{4}$ the total height of retort 10. Surrounding the heating zone, a plurality of induction coils 16 are disposed in such a way as to provide controlled heating by induction of coils 59 of compartments 11. Walls 59 are uniformly heated and each area encompassed by each coil 16 is selectively controlled for a specific energy input to give the maximum efficiency in driving the volatiles from the coal and in making possible the reaction of the char (coke) with steam to provide the most efficient method of volatilization and gasification. The rated energy delivered to walls 59 of each compartment 11 through induction coils 16 is such that carbonization of the coal generally begins at the walls at the top of each compartment and proceeds downwardly in such a manner as to be completely carbonized by the time the charge material reaches the bottom of compartment 11. Upon increasing the pressure within each compartment of retort 10 to about 400 p.s.i., the CO generated in the formation of the water gas at the bottom of each compartment 11 will react with the hydrogen-rich volatile matter of the coal to form methane within the unit and reduce the load requirement on the methanation outside retort 10 if the gas is to be upgraded to pipe line quality. The methanation within retort 10 being an exothermic reaction decreases the energy requirements of walls 59 and thereby reduces the power requirement of coils 16.

(vi) Structural Support 83

Figure 9:
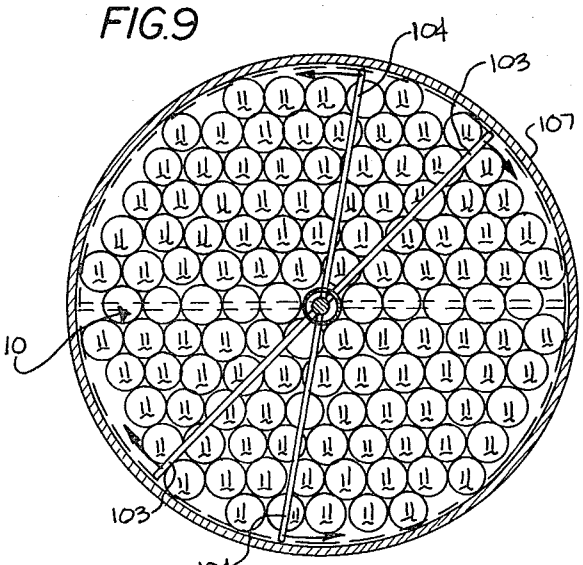

Retort 10, which may have any geometric configuration round as shown by FIG. 9 or hexagonal as shown in FIG. A, is supported by vertical structural supports 83 with trunions 98 suitably positioned along the height of retort 10. Restraining means 106 are mounted on trunions 98 and are adapted to be moved towards retort 10 to form hoops of massive holding capacity in order to hold retort 10 together as a unitized cluster, this being shown in FIG. 4.

(vii) Steam Injection System 13

Figure 8:
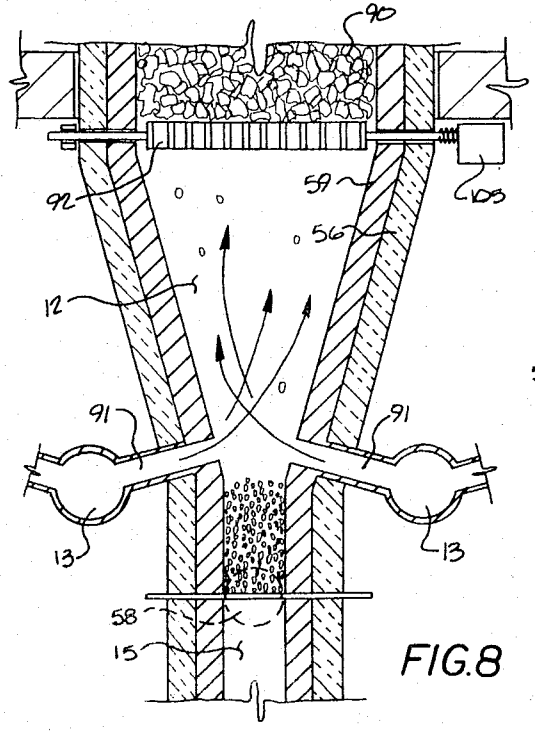

In order to make possible the generation of gas from the hot char (coke), steam is injected at the bottom of each compartment 11 by means of a steam injection system 13 as shown in detail in FIG. 8. The steam rises from the bottom of each compartment to react with the hot char to form $CO+H_2$.

(viii) Ash Disposal System 14

Figure 7:
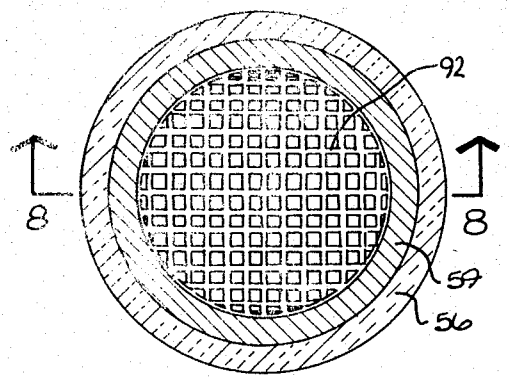
Figure 10:
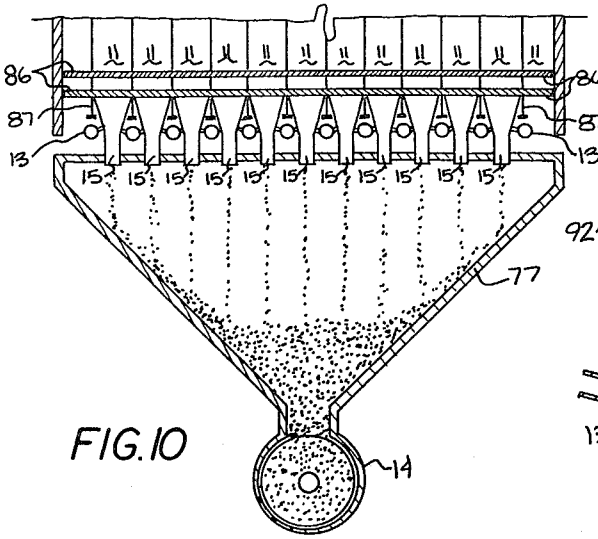

Each compartment 11 possesses a discharge chute 15 to direct the ash to disposal hopper 77 as shown by FIGS. 8 and 10. Grate 92 is disposed to the bottom of each compartment above steam injection system 13. Grate 92 may be equipped with vibrator means 105 to shake the grate and permit the ash to fall into chute 15, this being shown in FIG. 8. The ash accumulated is periodically fed into ash hopper 77 by means of gate 58. An enlarged view of grate 92 is shown by FIG. 7. The ash from hopper 77 is disposed as for example by screw conveyor 14. Instead of using hopper 77, a plurality of screw conveyors such as conveyor 85, may be mounted below a row of compartments 11 which would feed into main conveyor 14.

Figure 11:
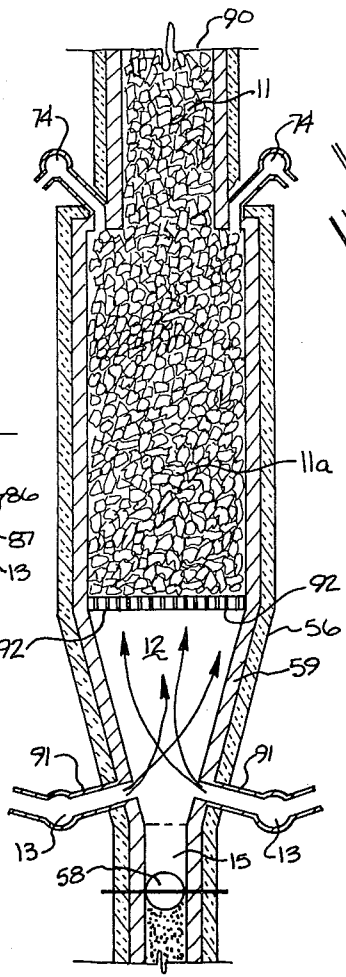

An alternate method of removing the gas from retort 10 is to provide intermediate gas removal ports 74 as shown in FIG. 11 and below the level of the coal in crown 17. In this arrangement, compartment 11 is made to possess a narrow cross section area above ports 74 and a wider cross section below ports 74. This arrangement is to minimize dust carry over from the coal.

OPERATION

While the operation of the apparatus of the present invention may be comprehended from a study of the foregoing description, it is believed that the operation of this apparatus and the method itself should be explained, as hereinafter set forth. The operation shall be described in conjunction with the following applications:

(a) In conjunction with power generation using a conventional oil and coal fired boiler.

(b) In conjunction with power generation using a combined cycle arrangement with excess air taken in at the turbine to prevent the overheating of the blades.
(c) In conjunction with power generation using a combined cycle arrangement with water cooled turbine blades.
(d) In conjunction with making gas for industrial use.
(e) In conjunction with making gas for up-grading to pipe line quality.
(f) In conjunction with making gas for conversion to liquid hydrocarbons.

Assuming that the apparatus has been initiated and the process is already operating, coal is charged into retort 10 through controlled charging system 18 and distribution-shearing paddle means 103 and 104 insure that all compartments 11 are supplied with coal. In using a caking coal, the coal will bloat and swell but paddle means 103 and 104 rotating in opposite direction to each other crush the bloated coal to break it into small pieces so that they fall into compartments 11. Since the temperature of the inner walls of crown 17 is maintained above 1000° F., and the temperature of walls 59 of compartments 11 is around 1600° F., the coal which touches the walls of crown 17 and the walls of compartments 11, will not stick to these walls. Instead the coal is roasted to become crispy and easily crushable. Because of the hot walls of each compartment, the volatiles from the coal are efficiently driven off. The height of compartments 11 are so designed that as the char is consumed at the bottom of each compartment above grate 92, more char descends to take the place of that char which was converted to water gas by the following reaction:

$$C(1300^\circ \text{ F. minimum}) + H_2O \text{ (steam)} = (CO + H_2) \text{ water gas} + 56{,}000 \text{ BTU/lb-mole.}$$

The heat in the char is furnished by the induction coils heating walls 59 of compartments 11 and also the char itself by direct induction. The steam for the reaction is injected at high pressure (about 500 p.s.i.) into each compartment 11, below or above grate 92 by means of steam injection 13. As the steam comes in contact with char at about 1600° F. water gas is formed and the char loses 56,000 BTU/lb-mole. The water gas ($CO+H_2$) rises in compartment 11 and comes in contact with $H_2$-rich gas leaving the coal during the carbonization of the coal and pressurized to disperse itself within each compartment 11. The CO in the water gas under a pressure of about 400 p.s.i. in an environment of coal volatiles which are very rich in $H_2$, converts to methane and water in the following reaction:

$$CO + 3H_2 + (400 \text{ psi}) = CH_4 + H_2O - 88{,}000 \text{ BTU/lb-mole.}$$

This exothermic reaction provides heat energy to the system to result in the reduction of the total energy requirement of induction coils 16.

Since induction coils 16 efficiently and rapidly heat walls 59 of compartments 11 as proved at Ohio State University, the heat expended by the formation of the water gas is rapidly put back into the remaining char by induction in order to convert better than 95% of the char to gas, while at the same time great heat energy is generated in the system by the formation of the methane. Each compartment 11 is very well insulated thermally, besides electrically, in order to prevent heat losses to insure that the heat introduced into each compartment 11 by induction as well as by exothermic reaction cannot leave the inside of compartment 11, and in so doing the system becomes most efficient in transfering the heat to the coal as well as to the char. Fiber-frax as an insulation material has proved to be most serviceable for confining the heat to the inside of each compartment 11. The operation of steam injection into each compartment 11 may be continuous, or semi-continous. If the introduction of the steam is continuous, the heat introduced by coils 16 and by internal methanation is balanced to make up the heat loss incurred by the making of the water gas. If the introduction of the steam is semi-continuous, compartments 11 are divided into groups #1 and #2; when group #1 is re-heated to make up for the endothermic reaction group #2 is injected with steam for water-gas formation, and when group #1 is injected with steam for water gas formation, group #2 is re-heated to make up for the endothermic reaction which had taken place.

The gas leaving crown 17, leaves at a high pressure and at a temperature of about 1000° F. to force the gas through desulfurizer 21 which operates efficiently to remove the sulfur in the gas at such temperature. The CaO or MgO fed into desulfurizer 21, gets poisoned after a certain period of time and is discharged for disposal. In operating retort 10, continuously, provisions are made to periodically stop the injection of steam into a bank of compartments 11, to shake the ash accumulated above grate 92 and for this purpose, compartments 11 are grouped into two or more banks. By following this procedure for steam injection and ash removal, part of retort 10 is always producing gas and enriching it, so that gas leaves retort 10, in a continuous stream even though a certain number of compartments 11 are not injected with steam during certain periods of time.

The usefulness of the instant invention is demonstrated as follows:

(a) In using this invention in conjunction with an oil or coal fired boiler, it is the intention to make the gas within retort 10, methanate it within the retort, desulfurize it and inject it into the boiler at a high pressure and high temperature in order to make use of the sensible heat in the gas. The burning of the gas with preheated air, the air being preheated in recuperators downstream of the boiler, will still add more efficiency to the system. In so doing, not only the efficiency of the boiler is increased but also the pollution problem created by acid rain is eliminated resulting from the reaction of hydrogen sulfide in the gas with calcium oxide or magnesium oxide in the desulfurizer. In addition, the high temperature of the gas when burned in the boiler with preheated air, the tars and phenols in the gas are incinerated; this then obviates the necessity of having a by-product plant.

This application is particularly important to oil-fired boilers from an economical standpoint, since the price of oil at this data averages $33.00 per barrel which contains roughly 6 million BTU's. This means that the cost per million BTU's for power plants using oil is $5.50. In gasifying with the instant invention, it is estimated that a million BTU's will cost around $3.50 at today's costs. Such a saving will be of great value to power plants using oil. Many power plants on the Eastern Seaboard of the United States are heavy users of oil and there is no relief in sight for them since the price of a barrel of oil is constantly on the increase.

In using this application with coal-fired boilers, the instant invention prevents the burning of any coal or char and the problems presented by the burning of coal are eliminated. Since it is the intent of this country's solution to the energy problem the greater use of coal, the burning of additional coal will aggrevate the pollution of the environment; therefore, it is of the utmost importance not to burn coal but to gasify it in such a manner that no air or oxygen is used during the gasification process.

(b) In using the instant invention in conjunction with power generation with a combined cycle arrangement, the intent of the instant invention is to use the gas hot and under pressure in conjunction with a gas turbine whose efficiency is higher than a steam turbine. This then will make possible an increase in efficiency and result in about 42% efficiency rather than 30% efficiency as is common in conventional steam turbines. The exhaust from the gas turbine is directed to a waste heat boiler for the making of steam to operate a steam turbine so that the gas turbine and the steam turbine work conjunctively. In this application, attention must be paid to the removal of particulates from the gas in order not to damage the blades of the gas turbine. Also, attention must be paid to prevent the over-heating of the blades by introducing excess air downstream of the combustion chamber prior to entry into the turbine.

(c) In using the instant invention in conjunction with power generation using a combined cycle arrangement with water-cooled turbine blades, it is the intent of the instant invention to operate the same as in paragraph (b) just described, except that no excess air is introduced into the gas turbine.

(d) In using the instant invention in conjunction with making gas for industrial use, the gas after desulfurization is quenched to remove the tars and phenols and transmitted under pressure to miscellaneous users.

(e) In using the present invention in conjunction with making gas of pipe-line quality, the gas after desulfurization is quenched to condense the tars and oils and is further methanated to pipe line quality, dehydrated and mixed with natural gas for transmission through the pipe line system.

(f) In using the present invention in conjunction with making gas for conversion to liquid hydrocarbon, the gas after desulfurization is quenched to remove the tars and phenols and is directed to a reaction process such as the Fischer-Tropsch process for liquification.

From the foregoing detailed description of the disclosure, it is evident that the instant invention is novel and is a contribution of great significance to the art of gasification, to the production of energy, to the control of emission, to the elimination of health hazards to the workers, to the improvement of the balance of payments, to the employment of an abundant domestic energy source (coal), and to the conservation of capital. All in all, it is submitted that the present invention provides a new and useful method and apparatus for the making of gas from coal efficiently in order to make available clean and abundant energy on which our country depends.

I claim:

1. A method of gasifying a carbonaceous fuel comprising the steps of charging the carbonaceous fuel into a plurality of compartments whose walls comprise a material which is adaptable to being heated by induction while the wall of each compartment envelopes the fuel which is charged into each compartment and wherein said plurality of compartments are grouped together and surrounded by an induction coil means so that all the compartments of said plurality of compartments commonly share said induction coil means and said induction coil means does not individually surround any of said compartments, heating said walls of said plurality of compartments by said induction coil means to cause the devolatilization of the carbonaceous fuel contained within each compartment of said plurality of compartments to convert said carbonaceous fuel to coke, subjecting said coke to a steam envoronment to gasify as least a portion of said coke to form water gas ($CO+H_2$), and collecting the gases generated.

2. The method as set forth in claim 1 wherein said step of heating said walls of said plurality of compartments by said induction coil means is further characterized by the step of insulating each compartment of said plurality of compartments in such a way as to have each compartment isolated from its adjacent compartment.

3. The method as set forth in claim 2 wherein said step of insulating said plurality of compartments is further characterized by the step of thermally insulating said plurality of compartments in such a way as to minimize heat loss from each compartment in order to efficiently drive the heat from the walls of each compartment to the carbonaceous fuel contained within each compartment.

4. The method as set forth in claim 2 wherein said step of insulating said plurality of compartments is further characterized by the step of electrically insulating said plurality of compartments in such a way as to minimize short-circuiting of the magnetic flux from one compartment to an adjacent compartment in order to uniformly heat the walls of said compartments.

5. The method as set forth in claim 1 wherein said step of heating said walls of said plurality of compartments by said induction coil means is further characterized by the step of locating each compartment of said plurality of compartments outside the confines of the other compartments.

6. The method as set forth in claim 1 wherein said step of charging the carbonaceous fuel into said plurality of compartments is further characterized by the step of distributing the charge into said plurality of compartments in such a way as to have substantially the same amount of said carbonaceous fuel delivered to each compartment of said plurality of compartments.

7. The method as set forth in claim 6 wherein said step of distributing the charge into said plurality of compartments is further characterized by the step of crushing said carbonaceous fuel to insure the flow thereof into and through said compartments.

8. The method as set forth in claim 1 further characterized by the step of adding supplemental heat to make up for the loss of heat which takes place when coke and steam react to make water gas ($CO+H_2$).

9. The method as set forth in claim 1 wherein said step of heating said walls of said plurality of compartments by said induction coil means to cause the devolatilization of the carbonaceous fuel contained within each compartment of said plurality of compartments is further characterized by the step of operating said plurality of compartments under positive pressure to produce at least some methane gas by the reaction of hydrogen contained in the products of said devolatilization with carbon contained in said carbonaceous fuel.

10. The method as set forth in claim 9 wherein said step of operating said plurality of compartments under positive pressure to produce at least some methane gas by the reaction of hydrogen contained in the products of devolatilization with carbon contained in said carbonaceous fuel is further characterized by the step of generating heat during the reaction of said hydrogen with said carbon.

11. The method as set forth in claim 10 wherein said step of generating heat during the reaction of said hydrogen with said carbon is further characterized by the step of employing the heat so generated to help reduce the total heat requirement of said method.

12. The method as set forth in claim 1 wherein said step of subjecting said coke to a steam environment to gasify at least a portion of the coke to form water gas ($CO+H_2$) is further characterized by operating said plurality of compartements under positive pressure to produce at least some methane gas by the reaction of CO and $H_2$.

13. The method as set forth in claim 12 whereifn said step of operating said plurality of compartments under positive pressure to produce at least some methane gas by the reaction of CO and $H_2$ is further characterized by the step of generating heat during the reaction of said CO with said $H_2$.

14. The method as set forth in claim 13 further characterized by the step of employing the heat so generated to help reduce the total heat requirement of said method.

15. The method as set forth in claim 1 further characterized by the step of employing said gas for drying and preheating the charge.

16. The method as set forth in claim 1 further characterized by the step of treating said gases.

17. The method as set forth in claim 16 wherein said step of treating said gases is further characterized by the step of removing of particulate matter from said gases prior to usage.

18. The method as set forth in claim 1 wherein said step of collecting the gases generated is further characterized by the step of directing said gases above said plurality of compartments.

19. The method as set forth in claim 1 characterized by the step of directing said gases to an intermediate point of said plurality of compartments.

20. The method as set forth in claim 1 being further characterized by the step of operating said method on a semi-continuous sequence.

21. The method as set forth in claim 1 being further characterized by the step of operating said method on a continuous sequence.

22. The method as set forth in claim 1 wherein the step of heating said walls of said plurality of compartments by said induction coil means to cause the devolatilization of the carbonaceous fuel contained within each compartment of said plurality of compartments to convert said carbonaceous fuel to a coke is further characterized by the step of subjecting the contents of said compartments to a divergent downward feed to minimize bridging of the carbonaceous fuel during its descent in said compartments.

23. The method as set forth in claim 1 wherein said plurality of compartments extend generally vertically, and wherein the step of heating the walls of said plurality of compartments by said induction coil means is further characterized by the step of heating said compartments in the vertical direction in zones to result in an efficient and controllable mode of heating.

24. The method a set forth in claim 1 wherein said step of subjecting said coke to a steam environment to gasify at least a portion of said coke to form water gas ($CO+H_2$) is further characterized by the step of disposing the ash residue resulting from the gasification of said coke.

25. The method as set forth in claim 24 wherein said step of disposing the ash residue resulting of the gasification of said coke is further characterized by the step of shaking the ash residue to facilitate disposal.

26. The method as set forth in claim 1 wherein said step of subjecting said coke to a steam environment to gasify at least a portion of said coke to form water gas ($CO+H_2$) is further characterized by desulfurizing said water gas.

27. The method as set forth in claim 1 wherein said step of charging the carbonaceous fuel and said step of collecting the gases generated by the method are further characterized by the step of carrying out the method in a nonpolluting manner.

28. The method as set forth in claim 1 wherein said step of collecting the gases generated by the method is further characterized by the step of maintaining the temperature of the gases generated above the condensation point of tar.

29. The method as set forth in claim 28 wherein said step of maintaining the temperature of the gases generated above the condensation of tar is further characterized by the step of incinerating the tars contained in said gases.

30. The method as set forth in claim 1 wherein said step of charging a carbonaceous fuel is further characterized by the step of charging a caking coal.

31. The method as set forth in claim 1 wherein said step of subjecting said coke to a steam environment to gasify at least a portion of said coke to form water gas ($CO+H_2$) is further characterized by the step of selectively injecting steam into one group of said compartments while adding heat into a second group of said compartments.

32. The method as set forth in claim 1 wherein said step of collecting the gases generated by the step of employing said gases for industrial use.

33. The method as set forth in claim 1 being further characterized by the step of producing liquid fuels in addition to gases while making use of said method.

34. The method as set forth in claim 1 being further characterized by the step of producing as of pipeline quality while making use of said method.

35. The method as set forth in claim 1 being further characterized by the step of producing electric power while making use of said method.

36. The method as set forth in claim 1 being further characterized by the step of producing chemical feedstock while making use of said method.

* * * * *